US007229524B2

(12) United States Patent
Snekkenes

(10) Patent No.: US 7,229,524 B2
(45) Date of Patent: Jun. 12, 2007

(54) FEEDING ARRANGEMENT FOR FEEDING OF CHIPS TO CHIP BINS

(75) Inventor: Vidar Snekkenes, Karlstad (SE)

(73) Assignee: Metso Fiber Karlstad AB (SE)

( * ) Notice: Subject to any disclaimer, the term of this patent is extended or adjusted under 35 U.S.C. 154(b) by 181 days.

(21) Appl. No.: 10/979,004

(22) Filed: Nov. 1, 2004

(65) Prior Publication Data

US 2005/0061464 A1 Mar. 24, 2005

Related U.S. Application Data

(62) Division of application No. 10/475,378, filed as application No. PCT/SE02/00845 on May 2, 2002, now abandoned.

(30) Foreign Application Priority Data

May 4, 2001 (SE) ..... 0101587

(51) Int. Cl.
*D21C 3/26* (2006.01)

(52) U.S. Cl. ..... 162/19; 162/52; 162/68; 162/242; 162/246; 162/18; 162/236; 162/237

(58) Field of Classification Search ..... 162/246, 162/236, 237, 18, 52
See application file for complete search history.

(56) References Cited

U.S. PATENT DOCUMENTS 2,905,240 A 9/1959 Sandberg
3,157,565 A 11/1964 Gremler
3,578,554 A 5/1971 Richter
3,729,105 A * 4/1973 Huebler et al. ..... 414/218
4,096,027 A * 6/1978 Sherman ..... 162/18
5,266,159 A * 11/1993 Greenwood et al. ..... 162/17
5,714,043 A 2/1998 Finley
5,720,232 A * 2/1998 Meador ..... 110/346
6,706,199 B2 * 3/2004 Winter et al. ..... 210/769

FOREIGN PATENT DOCUMENTS

SE 354086 1/1973

* cited by examiner

*Primary Examiner*—Mark Halpern
(74) *Attorney, Agent, or Firm*—Rolf Fasth; Fasth Law Offices

(57) ABSTRACT

The invention relates to a feed arrangement for feeding chips to chip bins (1) in the production of cellulose pulp in continuous digesters (16), in which the chip bin is constituted by a treatment vessel having a top and a bottom, in which the chips are fed into the top (13) of the treatment vessel and fed out via the bottom of the treatment vessel using suitable lock members (10, 11). Distribution devices (4*a*, 4*b*) for the addition of steam are disposed in the treatment vessel so as to heat the chips to a level above 80° C., preferably around 100° C., when the chips are fed out via the bottom of the treatment vessel. By virtue of the fact that the chips are fed into the treatment vessel via at least one liquid lock (30) and the treatment vessel is otherwise sealed off, the quantity of driven-off gases from the chip bin is reduced to a minimum, at the same time as an effective utilization of available energy is obtained.

9 Claims, 2 Drawing Sheets

FEEDING ARRANGEMENT FOR FEEDING OF CHIPS TO CHIP BINS

PRIOR APPLICATION

This application is a divisional patent application of U.S. national phase application Ser. No. 10/475,378 filed Oct. 22, 2003, now abandoned, that is based on International Application No. PCT/SE02/00845, filed 2 May 2002, claiming priority from Swedish Patent Application No. 0101587-4 filed 4 May 2001.

The present invention relates to a feed arrangement.

PRIOR ART

In connection with cut chips having to be fed into continuous digesters, in which digesters the chips are digested in order to obtain chemical cellulose pulp, the chips have to undergo a number of treatment stages.

The chips which are obtained following chipping take up a large volume in which the chip fragments only occupy ⅓ and the remaining ⅔ are air. In the actual chip fragment, only ⅓ is constituted by wood and the remaining part of the chip is constituted by chip moisture, ⅓, and air, ⅓.

Neither the air nor the chip moisture are desirable in the digestion process and are required to be expelled as much as possible. Just before the digestion, air and the chip moisture are thus replaced with treatment liquids necessary for the dissolution of the chip fragment. At the same time, it is desirable to heat the chips to the required process temperature, expediently to a level of around 100° C., since the chips will eventually reach temperatures of around 140-160° C. during the digestion. This calls for very large quantities of steam, since firstly a correct chip temperature has to be obtained with the aid of the steam and secondly bound air needs to be driven off with the steam, but also bound chip moisture has to be heated.

In certain older conventional feed arrangements atmospheric chip bins have been used, in which the chips are preheated with steam in order to expel the air. From these feed arrangements, very large volumes of drawn-off air are then obtained, which are contaminated with turpentine and other explosive gases, the latter referred to as NCG-gases (NCG=Non-Condensable Gases).

In U.S. Pat. No. 4,096,027 a solution is shown in which the chips are fed to the chip bin via an oblique screw. The chips are packed in the screw, whereupon a plug is formed which will prevent too much air from being transported into the chip bin. In this solution also, large quantities of free air are carried along with the chip fragments and also the air bound in the chips.

In U.S. Pat. No. 4,927,312 another variant is shown in which the feed-in to the chip bin is provided with swing doors which are regulated such that a certain quantity of chips lies on top of the swing doors in order to prevent toxic gases from reaching the environment.

In U.S. Pat. No. 5,766,418 a further solution is shown in which a physical restriction in the inlet will act against the chips such that a plug is formed.

In U.S. Pat. No. 6,143,134 yet another variant is shown in which a plug-forming inlet is provided with deflection plates which are individually controlled such that the chips can leave the stopper in various radial directions over the interior of the chip bin.

The prior art has identified the problem of wanting to minimize the leakage of harmful/toxic gases which arise during presteaming with hot steam. Yet there are large quantities of air left in the chips which are fed into the chip bin, thereby creating large volumes of the harmful gases which must be taken care of.

In the known chip bins in which steam is blown through the chips and large quantities of weak gases are generated, there is a need for either very pure steam or special feed arrangements which are capable of handling these gases. The weak gases have the peculiarity that they easily acquire a very explosive composition. Given a 10% TRS content, a very explosive gas is obtained if the oxygen has a 15-20% share. Normally, when presteaming takes place in chip bins, residual gases with oxygen components of 18-20% are obtained, so that either every effort must be made to have a very high flow of pure steam (in order to restrict the TRS content), thereby generating large volumes of these weak gases, or alternatively these gases have to be treated with the great care which is demanded. In the latter case, no emissions can be tolerated from the chip bin, since the obtained weak gases are directly harmful to persons working in the vicinity of the chip bin.

Another solution for minimizing the volumes of weak gases is to control the flow of chips through the chip bin such that a stable plug flow is obtained through the chip bin and in which steam is added to the chip bin in a controlled manner so that only the chips in the lower part of the bin are heated. This technique is known as "cold-top" control and is used in feed arrangements marketed by Kvaerner Pulping AB under the name DUALSTEAM™ bin.

A number of very expensive solutions have been proposed in order to reduce the explosiveness and toxicity of the weak gases. In WO 96/32531 and U.S. Pat. No. 6,176,971, for example, various feed arrangements are shown in which digestion liquor drawn off from the digester generates pure steam from ordinary water. The use of totally pure steam for presteaming the chips reduces the TRS content in the weak gases, since the steam used is totally free from any TRS content. These feed arrangements inevitably give rise, however, to energy losses and the additional cost of process equipment.

Proposals which actively reduce the free and bound quantity of air which is transported and which allow a leak-tight feed arrangement to be obtained have not been presented in any known feed arrangement for feeding chips to chip bins. In reality, the use of chip plugs as stoppers to prevent gas leakage is an impossibility bearing in mind the degree of packing and characteristics of the chips, in which at least ⅓ of the actual chips is constituted by air.

Already in SE-C-63003 from the year 1924 (inventor T. Molin), a feed arrangement for displacing the chip moisture (the wood's primary water) was shown. This paid no regard, however, to its potential for use as the inlet into the steaming operation. Instead, it was stated that this liquid-lock-resembling displacement feed arrangement should be preceded by a steam-preheating operation, and so there are no proposals for solving the problem at issue. Instead, the need to expel the chip moisture from the chips just before they are digested is clearly identified.

Surprisingly enough, there have been no better feed arrangements put forward than chip-plug-forming feed arrangements to the chip bin. Instead, attempts have been made to circumvent the problems with harmful gases by trying to generate purer steam from the digestion process, which was realised at the expense of high investment costs and reduced utilization of the thermal capacity.

THE PURPOSE AND OBJECT OF THE INVENTION

The main object of the invention is to obtain a chip bin for the presteaming of chips in which the risks of leakage of weak gases are minimized and which is not associated with the drawbacks of the prior art.

Another object is simultaneously to minimize the quantity of air which is transported down into the chip bin and which has to be evacuated during the presteaming. If this quantity of free air and air bound in the chips can be reduced, then the volumes of weak gases can be drastically reduced.

A further object is simultaneously to be able to evict the chip moisture from the chips, which chip moisture is undesirable in the subsequent digestion process. If a substantial quantity of chip moisture can already be expelled in the feed-in to the chip bin, then the steam supply does not need to be governed by this requirement and can be made more effective. If the chip moisture can instead be replaced with useful treatment chemicals, then these can be left in the chips.

Yet another object is to enable use of the steam which is obtained directly following the decompression of drawn-off digestion liquor from the digester, even if this steam contains a lot of NCG-gases. If the leak-tightness of the chip bin can be guaranteed, at the same time as presteaming is conducted without the blow-through of steam, using "cold-top" regulation as it is known, then this energy-optimal method for recovering heat from the digestion process can be used under controlled forms and with the least possible risks.

A further object is to be able to allow a pretreating impregnation of the chips with suitable treatment chemicals.

DETAILED DESCRIPTION OF PREFERRED EMBODIMENTS

Figure 1:
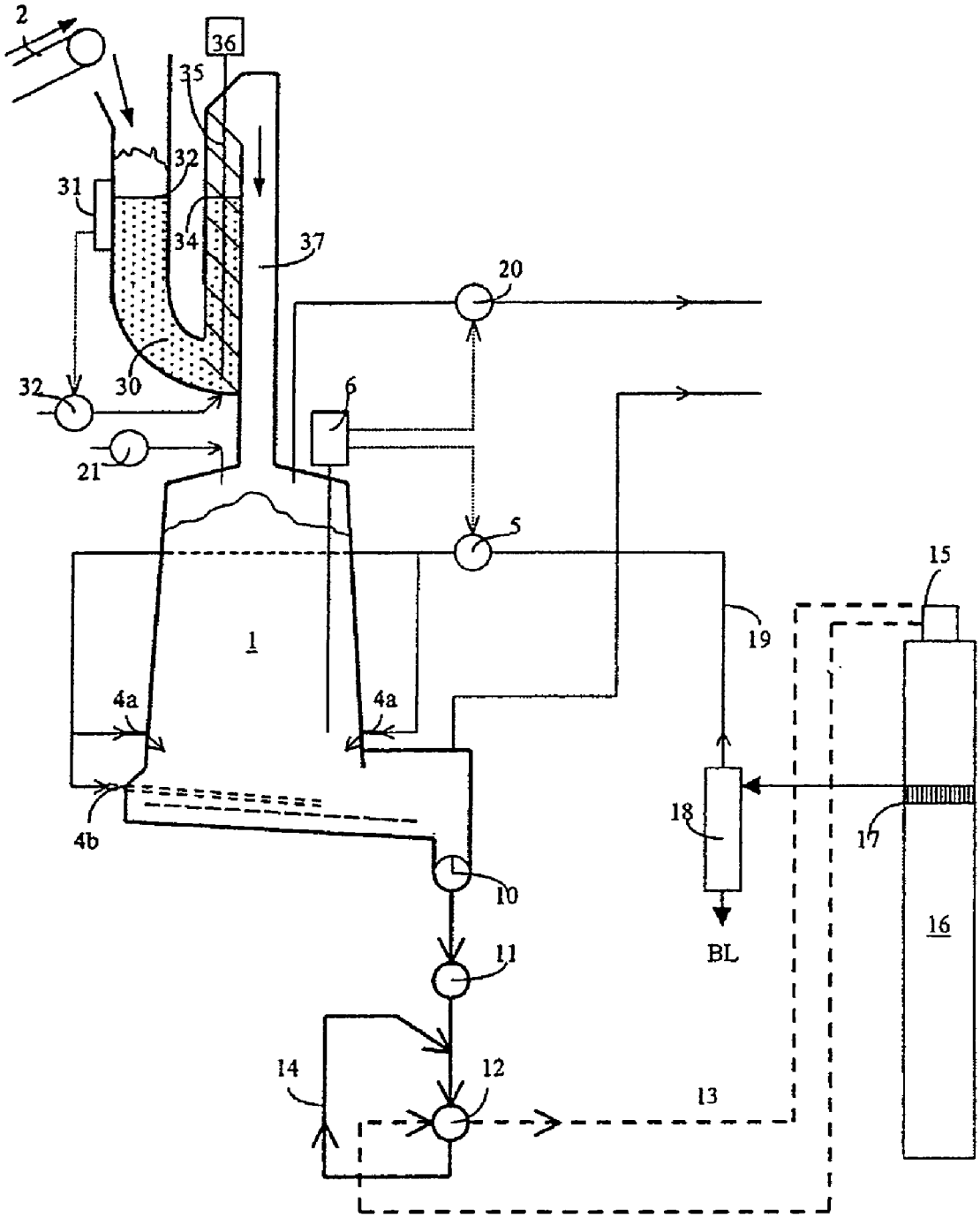
FIG. 1 shows in diagrammatic representation a feed arrangement according to the invention for feeding chips to chip bins in the production of cellulose pulp in continuous digesters.

In FIG. 1 a diagrammatic representation is shown of a chip bin 1 to which cut chips are conveyed by means of a conveyor belt 2 from a chip store (not shown). The chips at this stage have a temperature equivalent to the environment, anything from a few degrees below zero to 20-30° C. (during the warm season). Normally the chips are heated in the chip bin to a level above 80° C., preferably around 100° C., which calls for substantial quantities of steam. The heating with steam serves a number of purposes, firstly to raise the temperature of the chips, but also to expel air and heat bound chip moisture and, to a certain extent, drive off this chip moisture.

Figure 4:
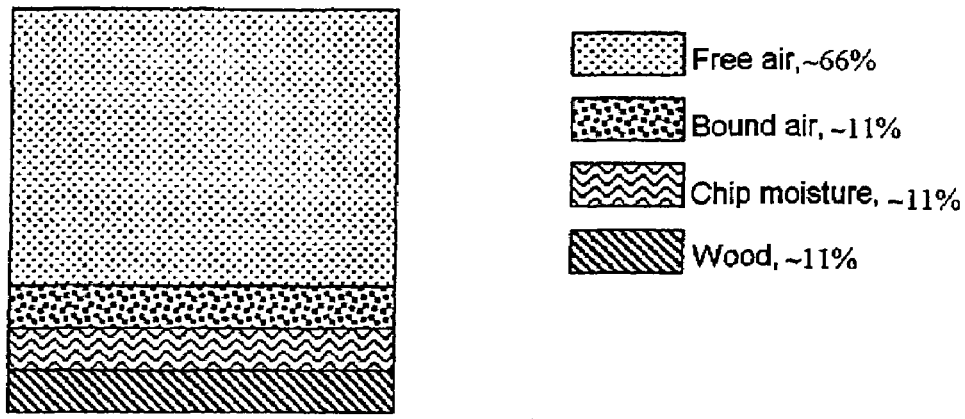
FIG. 4 shows in diagrammatic representation approximate proportions by volume of the component parts of the chips (not compressed)

In FIG. 4 a diagrammatic representation is shown of the volume shares of what normally accompanies the chips to the chip bin if the chips are not actively compressed. The free air, i.e. the air lying around and between the chip fragments, constitutes as much as ⅔. Even though active compression of the chips might be achieved, only a minor reduction of the free air is obtainable. In the actual chip fragment, which constitutes the remaining ⅓, the wood content accounts for ⅓, chip moisture ⅓ and air bound in the chip fragment ⅓.

The heating in the chip bin 1 is effected with a number of distribution devices for the addition of steam. In the embodiment shown, a lower distribution pipe **4*b* and a plurality of upper distribution nozzles 4*a* arranged all around the lower part of the chip bin are used. The quantity of steam which is supplied is regulated by means of the valve 5 as a function of the detected temperature in the chip bin, measured by means of the measuring device 6**. Through correct controlling, a so-called "cold-top" regulation is able to be obtained, so that a successive heating of the chip is obtained down through the chip bin. The chips in the upper part of the chip bin can then be kept at a temperature substantially below 80° C., preferably below 50° C.

When the chips are heated in the chip bin, regardless of whether pure steam or NCG-containing steam is used, harmful gases are generated, primarily containing turpentine, but also other harmful NCG-gases. With a view to handling these released gases, a feed arrangement is used having a venting facility via a pump 20 and a regulated inflow of fresh air via the control valve 21. The control valve 21 is expediently a one-way valve which opens for fresh air in the event of a certain underpressure in the chip bin. A certain controlled ventilation flow, so-called "sweep air", can thereby be obtained in the upper part of the chip bin. In certain feed arrangements, an overpressure control can also be installed, in which overpressure in the chip bin can be ventilated away via a safety system or in certain cases to an outlet on the roof of the plant. Normally, this overpressure can be led off via a pipe system connected to the suction side of the pump 20, thereby dealing with the excess quantities of gas which the pump 20 does not have the capacity to manage. In all normal operating situations, the pump 20 is dimensioned, however, such that it is capable of conducting obtained quantities of gas to a destruction svstem. With controlled "cold-top" regulation of the chip bin, the pump will always, however, cope with the air quantities which ventilate the chip bin.

After the chips have been heated to a suitable temperature and the majority of the air and chip moisture has been driven off, the chips are fed out from the bottom of the chip bin with a suitable discharge device 10, preferably a feed screw, and onward to a low-pressure feeder 11 (lock device) forming part of a feed arrangement to the high-pressure feeder 12. The low-pressure feeder feeds the chips to a downpipe, where the chips are mixed together with a preliminary transport/digestion liquid. The chip mixture is then fed to a conventional high-pressure feeder (also referred to as "pocket feeder") provided with bins which, as they rotate, can be filled with the chip mixture (normally from above) from the low-pressure system and, after 90-degree rotation, expose the bin, filled with the chip mixture, to the high-pressure circuit 13, which feeds the chip mixture under high pressure to a top separator 15 disposed in the top of a continuous digester 16. In the top separator the chips are separated from the transport liquid, which transport liquid is fed back to the inlet side of the high-pressure feeder within the high-pressure circuit.

In the shown feed arrangement, steam for the heating of the chip bin is obtained by warm black liquor at or close to boiling temperature, typically 140°-160° C., being drawn off from the digester via a drain sieve 17, after which it is decompressed in a cyclone 18. The steam 19 is tapped from the top of the cyclone and the black liquor BL is passed on to the evaporation unit in the usual manner. The steam can, however, be produced differently, for example by heating pure water by means of a heat exchanger, so that pure steam for the chip bin can be obtained.

With a leak-tight feed arrangement in the chip bin, the more energy-favourable steam which is obtained directly with the decompression of the black liquor can, however, be used, without any energy losses being suffered.

According to the invention, at least one liquid lock 30 is arranged between the chip feed 2 and the upper part of the chip bin. The chips are fed down to the liquid lock and form a chip level over a first liquid surface 33 in the liquid lock 30. Owing to the natural weight of the chips, the chips are fed towards the bottom of the liquid lock. The liquid lock in FIG. 1 is U-shaped with a feed screw 35 driven by a motor 36 disposed in the second outlet branch. The feed screw catches the chips advanced by the chip column in the inlet branch and, under rotation from the feed screw, the chips are fed up to and past the second liquid surface 34 in the liquid lock. After the chips have been drained of the liquid from the liquid lock, the chips tumble down to the chip bin 1 via the downpipe 37.

The liquid lock has the effect that all the free air surrounding and between the chip fragments can be driven off, at the same time as a certain part of the air bound in the chips is able to be driven off before the chips reach the chip bin and this without the need to use any compression equivalent to the solution in U.S. Pat. No. 4,096,027, which latter solution can only at best attain 20-30% of the capacity of the water lock to evacuate air.

Figure 2:
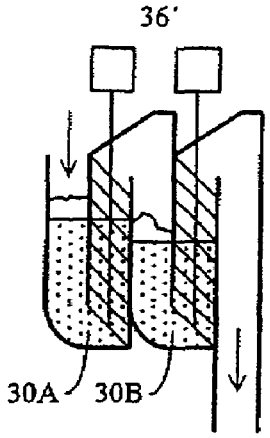
FIG. 2 shows a variant of the invention having two liquid locks in series in the feed-in to the chip bin.

In FIG. 2 a variant is shown having two liquid locks in series. With a plurality of locks in series a successive heating can be used, with liquid at 50 degrees in the last lock and liquid with a temperature lower, or possibly just 5-10 degrees higher, than the chips in the first lock. A suitable liquid can be black liquor or release liquor which provides an initial impregnation of the chips. Since most chip moisture is driven off in the first liquid lock, the liquid in the liquid lock can also be circulated in counter-current between the liquid locks.

Liquids other than black liquor can, of course, be used in digestion processes where this might be profitable. For example, impregnation liquids with a certain polysulphide, anthraquinone, white liquor or sulphur component may be used.

Figure 3:
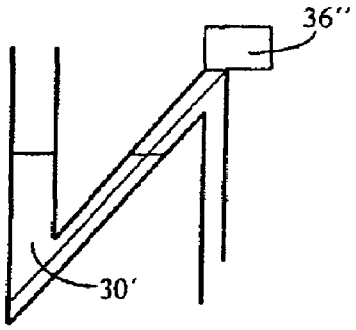
FIG. 3 shows a third variant having an oblique feed screw.

In FIG. 3, a further variant is shown having a liquid lock with an oblique feed screw (only the shaft shown).

The invention results in the chips being able to receive an initial heating to a moderate temperature even whilst they are in the liquid lock. The steam does not therefore need to be used to raise the temperature of the chips from the ambient temperature (a few degrees below zero to 20-30° C.) right up to a required temperature of around 100° C. Normally there are large quantities of black liquor at a pulp mill, kept at temperatures of around 70-90° C., so that the total utilization of energy at the pulp mill is improved. One of the most important distinguishing features is, however, that the quantity of air which is drawn with the chips into the chip bin is reduced to a minimum.

The invention can be varied in a number of ways within the scope of the appended patent claims. For example, the chips can be fed through the chip bin using the natural weight of the chips, thereby allowing the feed screw to be dispensed with.

Where a feed screw is used, it is expediently designed with drainage ducts and holes in its thread flanks. The feed screw can also be combined with drainage walls in the outlet branch of the liquid lock.

Feed screws can also be replaced with other transport devices, such as open belt/chain conveyors with carriers.

New liquid can expediently be supplied to the liquid lock such that this supply interacts with stratification effects owing to density differences between expelled chip moisture and liquid lock liquid (black liquor), in which case continuous/intermittent drawing-off of expelled chip moisture can be implemented.

In the outlet branch of the liquid lock there can also be found various forms of pressure devices in the form of interacting rollers or spring-loaded shutters, etc., which help to drain away excess liquid in the chips before the chips tumble downwards into the chip bin.

The invention can be used with steam of different grades of NCG-content, i.e. everything from totally pure steam (produced from heated-up pure water) to the steam which is obtained directly upon the decompression of digestion liquid from a digester.

The invention claimed is:

1. A method of feeding wood chips to a treatment vessel for production of cellulose pulp, comprising:

providing a liquid lock having a liquid disposed therein forming a first liquid surface, a bottom of the liquid lock and a second liquid surface, the liquid lock being upstream of a treatment vessel, the liquid of the liquid lock blocking air passage through the liquid lock to or from the treatment vessel, feeding untreated or un-steamed wood chips at essentially ambient temperature down to the liquid lock and forming a chips column on the first liquid surface, advancing the chips column of wood chips through the first liquid surface, passing the wood chips through the liquid lock for driving off all free air surrounding the wood chips and preventing essentially all free air from passing the liquid lock, feeding the wood chips through the second liquid surface, the wood chips, essentially being without any free air disposed around the wood chips, tumbling down through a down-pipe to the treatment vessel without compressing the wood chips, exposing the wood chips to steam to remove air bound in the wood chips from the wood chips so that a quantity of air which is drawn with the wood chips to the treatment vessel is reduced to a minimum, and heating the wood chips to at least 80° C. in the treatment vessel prior to discharging the wood chips from the treatment vessel.

2. The method according to claim 1 wherein the method further comprises monitoring a liquid level of the liquid in the liquid lock.

3. The method according to claim 2 wherein the method further comprises providing additional liquid when the liquid level falls below a minimum predetermined liquid level.

4. The method according to claim 1 wherein the method further comprises maintaining a minimum liquid level in the liquid lock.

5. The method according to claim 1 wherein the method further comprises detecting a liquid level in a liquid lock and generating an alarm when the liquid level falls below a minimum liquid level.

6. The method according to claim 1 wherein the method further comprises adding steam to the treatment vessel.

7. The method according to claim 6 wherein the method further comprises regulating the added steam by a control valve.

8. The method according to claim 1 wherein the method further comprises measuring a temperature of the chips and maintaining a temperature of chips at a bottom of the treatment vessel above 80° C.

9. The method according to claim 8 wherein the method further comprises maintaining a temperature of the chips at a top of the treatment vessel below 80° C.

* * * * *